US006421882B1

(12) United States Patent
Liao et al.

(10) Patent No.: US 6,421,882 B1
(45) Date of Patent: Jul. 23, 2002

(54) HANDLE ASSEMBLIES FOR FURNITURE

(76) Inventors: Pi-Hsia Liao; Li-Hsin Yeh, both of P.O. Box 63-247, Taichung (TW)

( * ) Notice: Subject to any disclaimer, the term of this patent is extended or adjusted under 35 U.S.C. 154(b) by 0 days.

(21) Appl. No.: 09/548,752

(22) Filed: Apr. 13, 2000

(51) Int. Cl.[7] ..... A47J 45/00
(52) U.S. Cl. ..... 16/445; 16/415
(58) Field of Search ..... 16/445, 408, 415–419, 16/420, 446, DIG. 41, 409, 430, 444; 312/244

(56) References Cited

U.S. PATENT DOCUMENTS 1,619,097 A * 3/1927 Archer ..... 292/348
3,135,010 A * 6/1964 Rossien ..... 16/112
3,248,750 A * 5/1966 Black ..... 16/126
3,416,184 A * 12/1968 Deadrick ..... 16/112
3,559,779 A * 2/1971 Lautin ..... 190/58
3,769,655 A * 11/1973 Cartwright ..... 16/126
3,804,290 A * 4/1974 Billman ..... 220/72
4,009,506 A * 3/1977 Henrikson ..... 16/126
4,056,864 A * 11/1977 Driesenga ..... 16/126
4,189,804 A * 2/1980 Fowerday ..... 16/126
4,364,150 A * 12/1982 Remington ..... 16/126
5,012,553 A * 5/1991 Hardigg et al. ..... 16/126
5,461,755 A * 10/1995 Hardigg et al. ..... 16/112

* cited by examiner

*Primary Examiner*—Anthony Knight
*Assistant Examiner*—John B. Walsh
(74) *Attorney, Agent, or Firm*—Alan Kamrath; Rider, Bennett, Egan & Arundel, LLP

(57) ABSTRACT

A handle assembly includes a positioning member and a handle. The positioning member includes a rear surface mounted to furniture and a front surface having no functional projection thereon. The handle includes two ends pivotally connected to two lateral surfaces of the positioning member, respectively. In another embodiment of the invention, the handle assembly includes two positioning members and a handle. Each positioning member includes a rear surface mounted to furniture and a front surface having no functional projection thereon. The positioning members further include mutually facing inner sides. The handle includes two ends pivotally connected to the inner sides of the positioning members, respectively.

10 Claims, 12 Drawing Sheets

A-A

A-A

HANDLE ASSEMBLIES FOR FURNITURE

BACKGROUND OF THE INVENTION

1. Field of the Invention

The present invention relates to handle assemblies for furniture, and more particularly to handle assemblies for furniture that provide diverse decorative designs.

2. Description of the Related Art

FIG. 1 of the drawings illustrates a conventional furniture handle assembly including two discs 10 attached to furniture and a handle 12. Each disc 10 includes a stub 11 projected from an outer face 101 thereof, and the handle 12 is pivotally mounted between the stubs 11. Provision of the stubs 11 prevents the handle 12 from being abutted against the furniture that may cause inconvenience to operation of the handle 12. Nevertheless, the decorative pattern in the discs 10 is monotonous and allows little space to change, as the stub 11 occupies a considerable area of the disc 10.

SUMMARY OF THE INVENTION

It is an object of the present invention to provide a handle assembly for furniture that allows diverse decorative designs.

In an embodiment of the invention, the handle assembly includes a positioning member and a handle. The positioning member includes a rear surface mounted to furniture and a front surface having no functional projection thereon. The handle includes two ends pivotally connected to two lateral surfaces of the positioning member, respectively.

In another embodiment of the invention, the handle assembly includes two positioning members and a handle. Each positioning member includes a rear surface mounted to furniture and a front surface having no functional projection thereon. The positioning members further include mutually facing inner sides. The handle includes two ends pivotally connected to the inner sides of the positioning members, respectively.

The handle assemblies in accordance with the present invention allow diverse decorative designs by means of providing positioning member(s) having a flat front surface. Thus, more decorative designs can be created, as the front surface has no functional projection (the stub 11 in FIG. 1) thereon.

Other objects, advantages, and novel features of the invention will become more apparent from the following detailed description when taken in conjunction with the accompanying drawings.

DETAILED DESCRIPTION OF THE PREFERRED EMBODIMENTS

Figure 2:
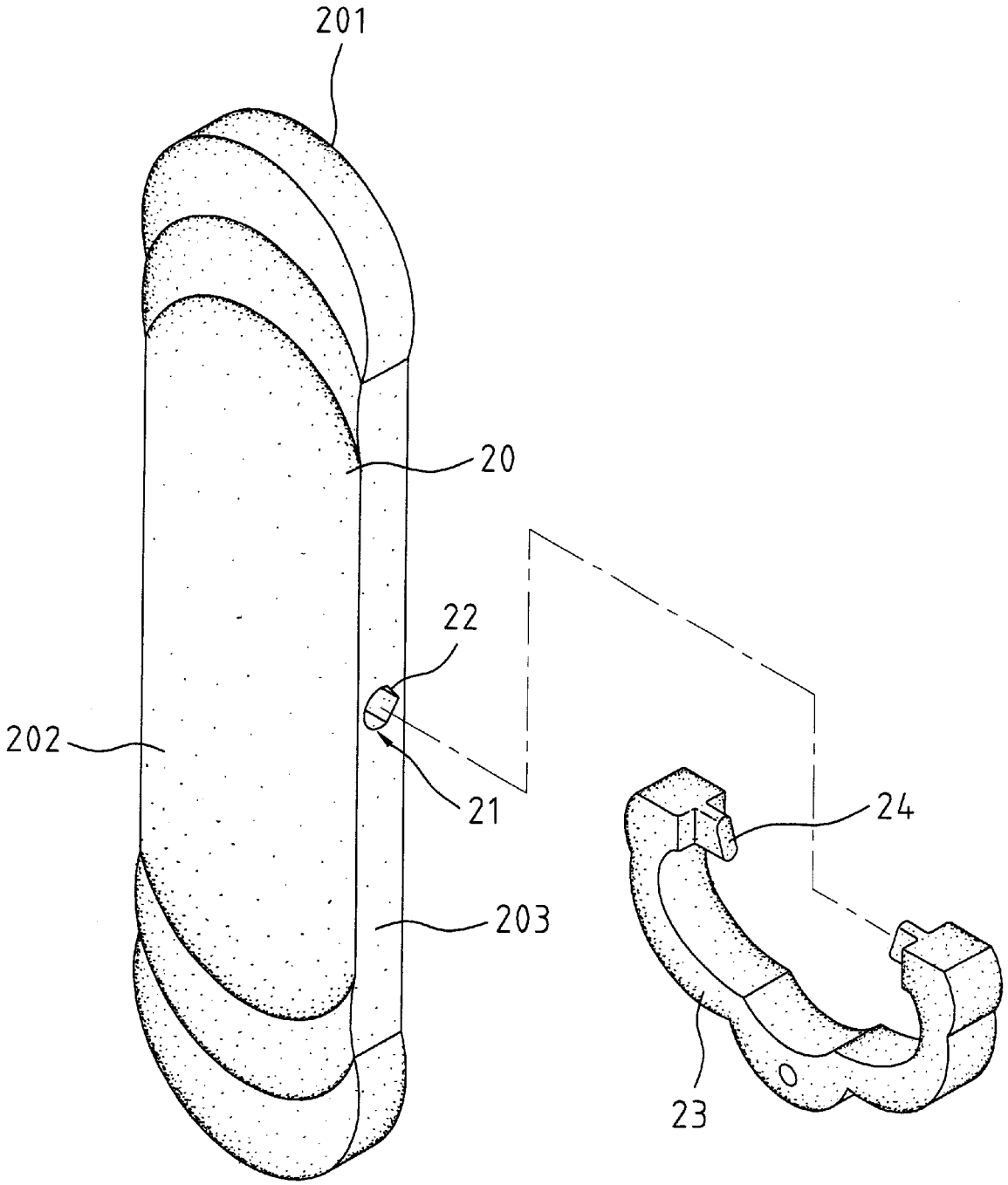
FIG. 2 is an exploded perspective view of a first embodiment of a handle assembly in accordance with the present invention.
Figure 3:
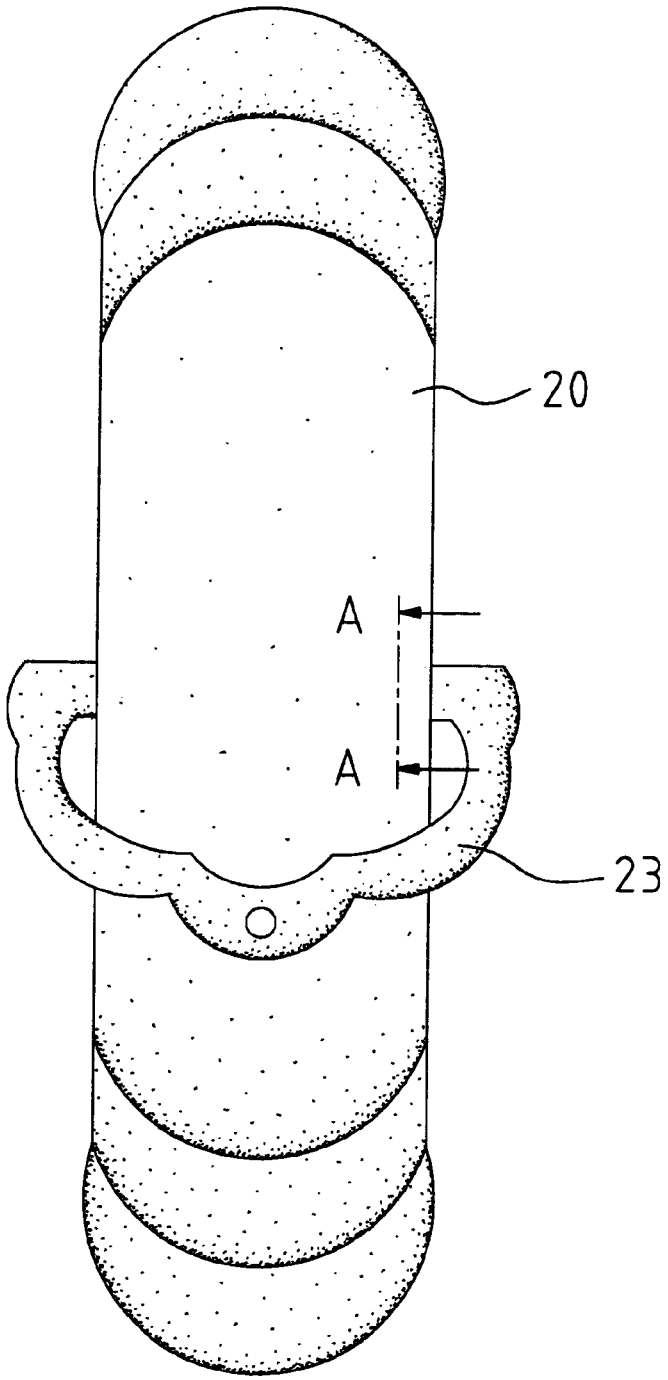
FIG. 3 is a side view of the handle assembly in FIG. 2.
Figure 4:
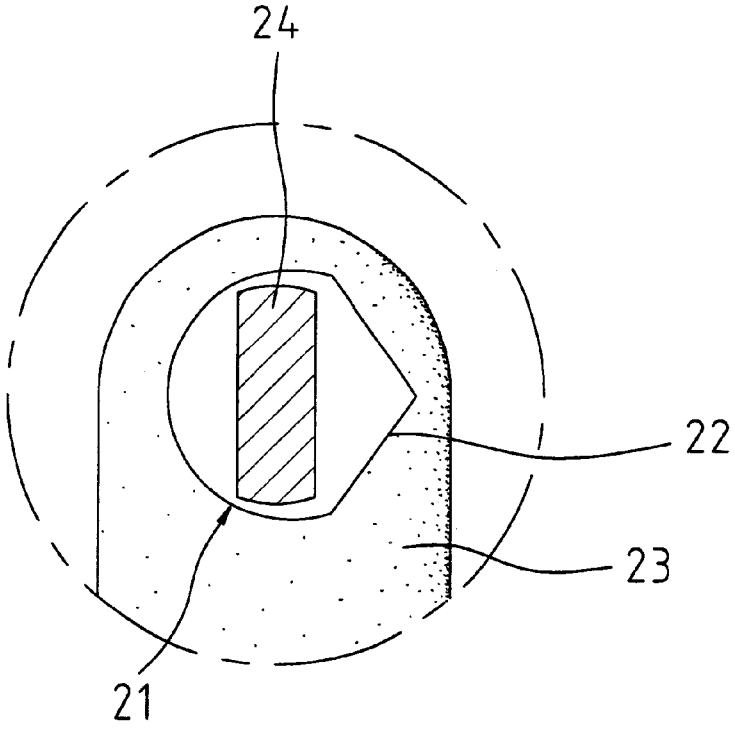
FIG. 4 is a sectional view taken along line A—A in FIG. 3.
Figure 5:
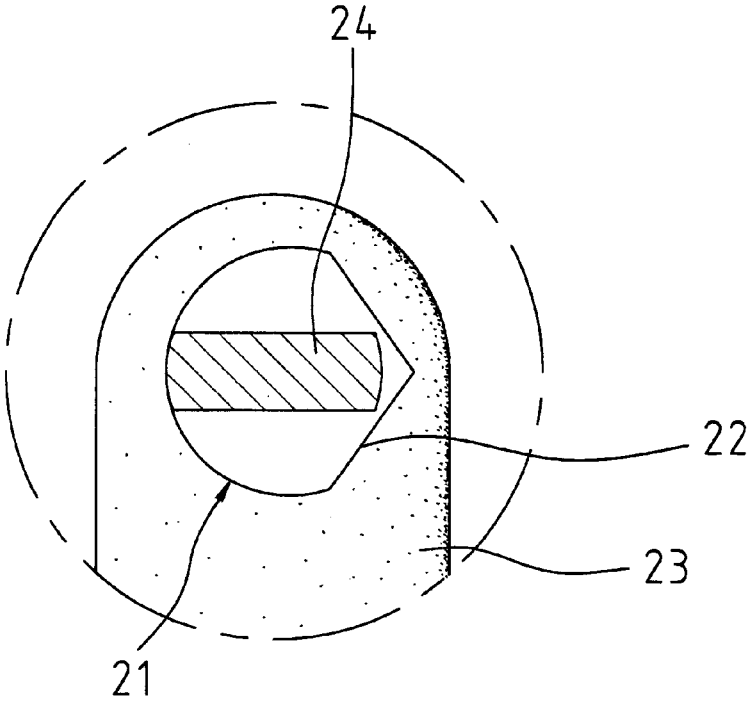
FIG. 5 is a view similar to FIG. 3, wherein the handle is in an operative position.

Referring to FIGS. 2 through 10 and initially to FIGS. 2 and 3, a first embodiment of a handle assembly in accordance with the present invention generally includes a positioning member 20 and a handle 23. The positioning member 20 includes a rear surface 201 that is attached to (e.g., by bonding) a furniture piece (e.g., a drawer) and a front surface 202. It is noted that the front surface 202 is flat (as it has no stub) and thus provides a wider area for decorative purpose. Each lateral surface 203 of the positioning member 20 includes a pivotal hole 21. The handle 23 is substantially U-shape and has two ends each having a pin 24 formed thereon. Each pin 24 extends along an axis that is at an angle with a plane on which the handle 23 is located. Each pin 24 is pivotally received in an associated pivotal hole 21. As illustrated in FIGS. 3 and 4, the pivotal hole 21 includes a conic section 22 to retain an associated pin 24 in a place such that a gap exists between the handle 23 and the positioning member 20 when the handle 23 is in a rest position, thereby allowing easy movement of the handle 23. Namely, the handle 23 can be easily grasped and turned to a position (see FIG. 5) for operation.

Figure 6:
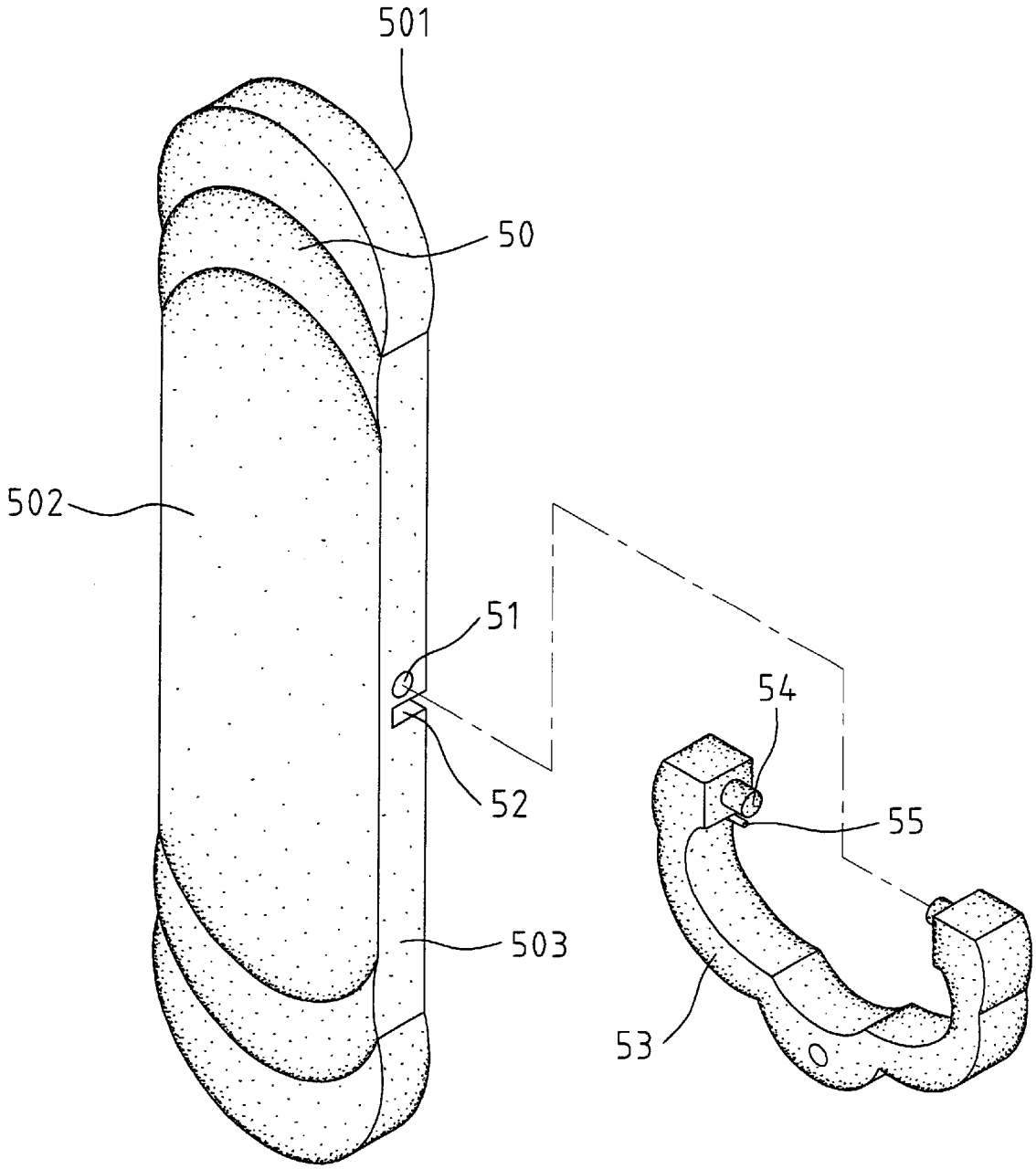
FIG. 6 is an exploded perspective view of a second embodiment of the handle assembly in accordance with the present invention.

FIG. 6 illustrates a second embodiment of the handle assembly in accordance with the present invention. The handle assembly includes a positioning member 50 and a handle 53. The positioning member 50 includes a rear surface 501 that is attached to (e.g., by bonding) a furniture piece (e.g., a drawer) and a front surface 502. It is noted that the front surface 502 has no stub and thus provides a wider area for decorative purpose. Each lateral surface 503 of the positioning member 50 includes a pivotal hole 51. Defined adjacent to each pivotal hole 51 is a retaining notch 52. The handle 53 is substantially U-shape and has two ends each having a pin 54 formed thereon. A stop 55 is formed adjacent to each pin 54. Each pin 54 is pivotally received in an associated pivotal hole 51. It is appreciated that each retaining notch 52 retains the associated stop 55 in a place such that a gap exists between the handle 53 and the positioning member 50 when the handle 53 is in a rest position, thereby allowing easy movement of the handle 53. Namely, the handle 53 can be easily grasped and turned to a position for operation.

Figure 6A:
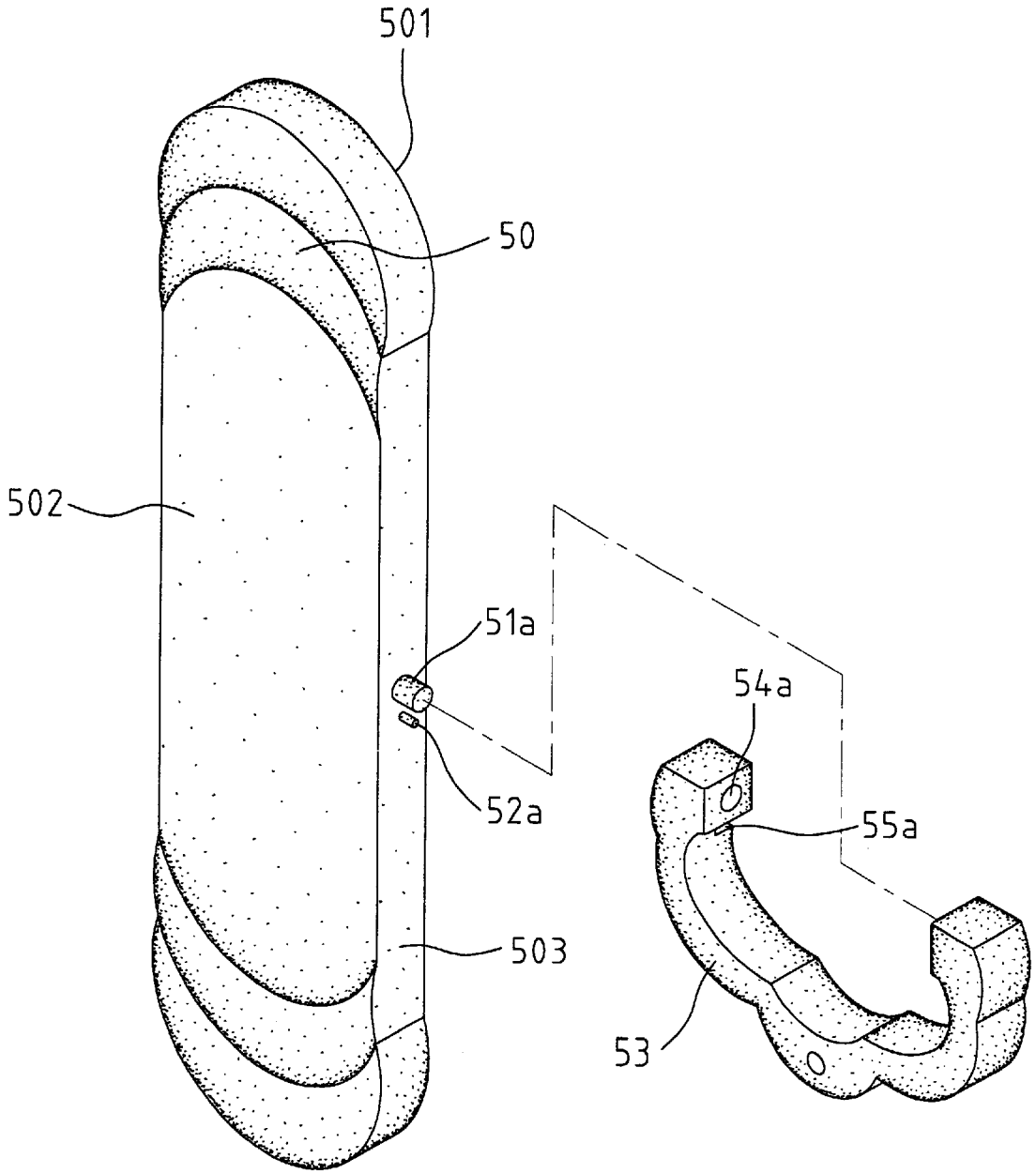
FIG. 6*a* is an exploded perspective view of an embodiment modified from the second embodiment.

FIG. 6*a* illustrates an embodiment modified from the second embodiment, wherein each lateral surface 503 of the positioning member 50 includes a pin 51*a* and a stop 52*a*, and each end of the handle 53 includes a pivotal hole 54*a* and a retaining notch 55*a*.

Figure 7:
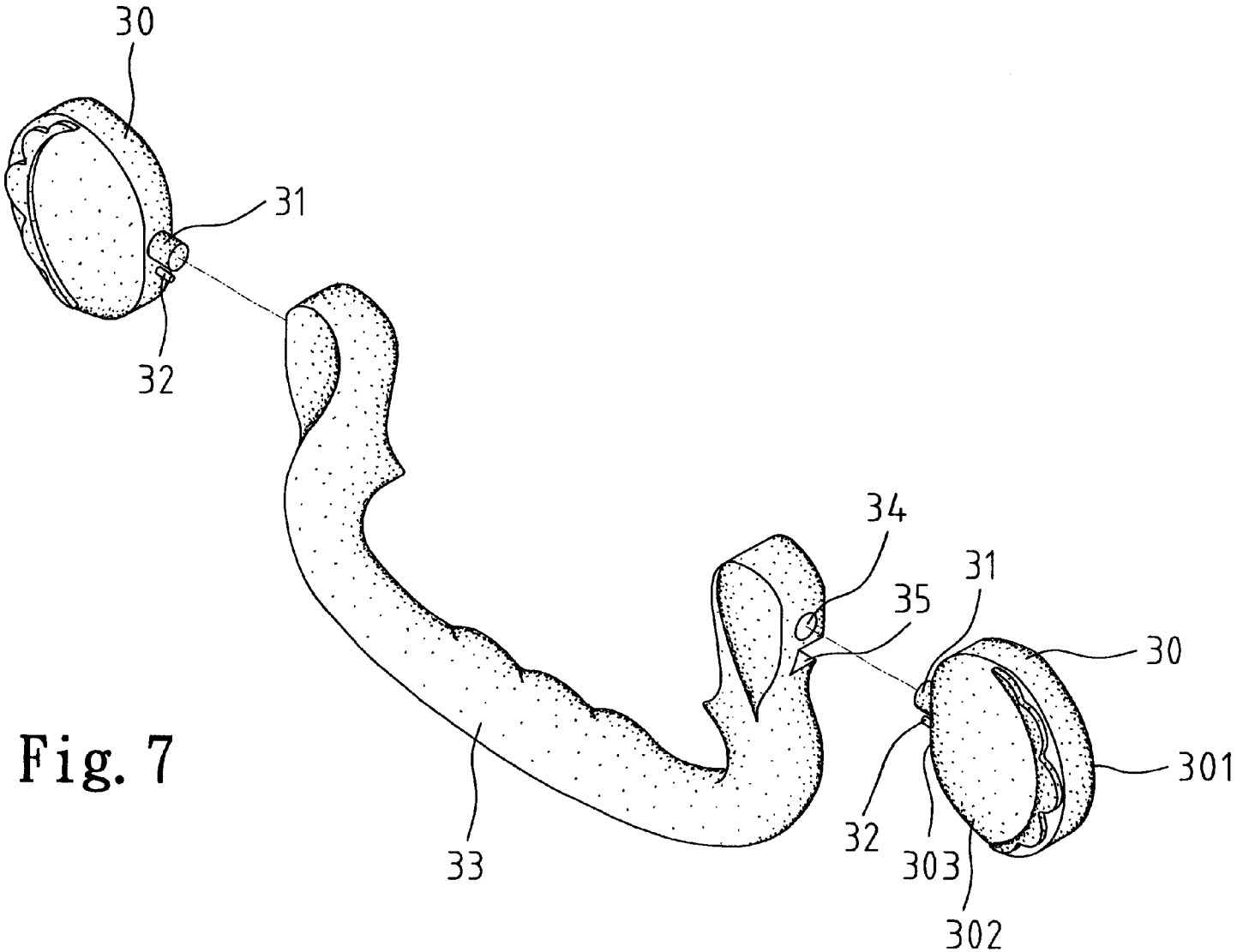
FIG. 7 is an exploded perspective view of a third embodiment of the handle assembly in accordance with the present invention.
Figure 8:
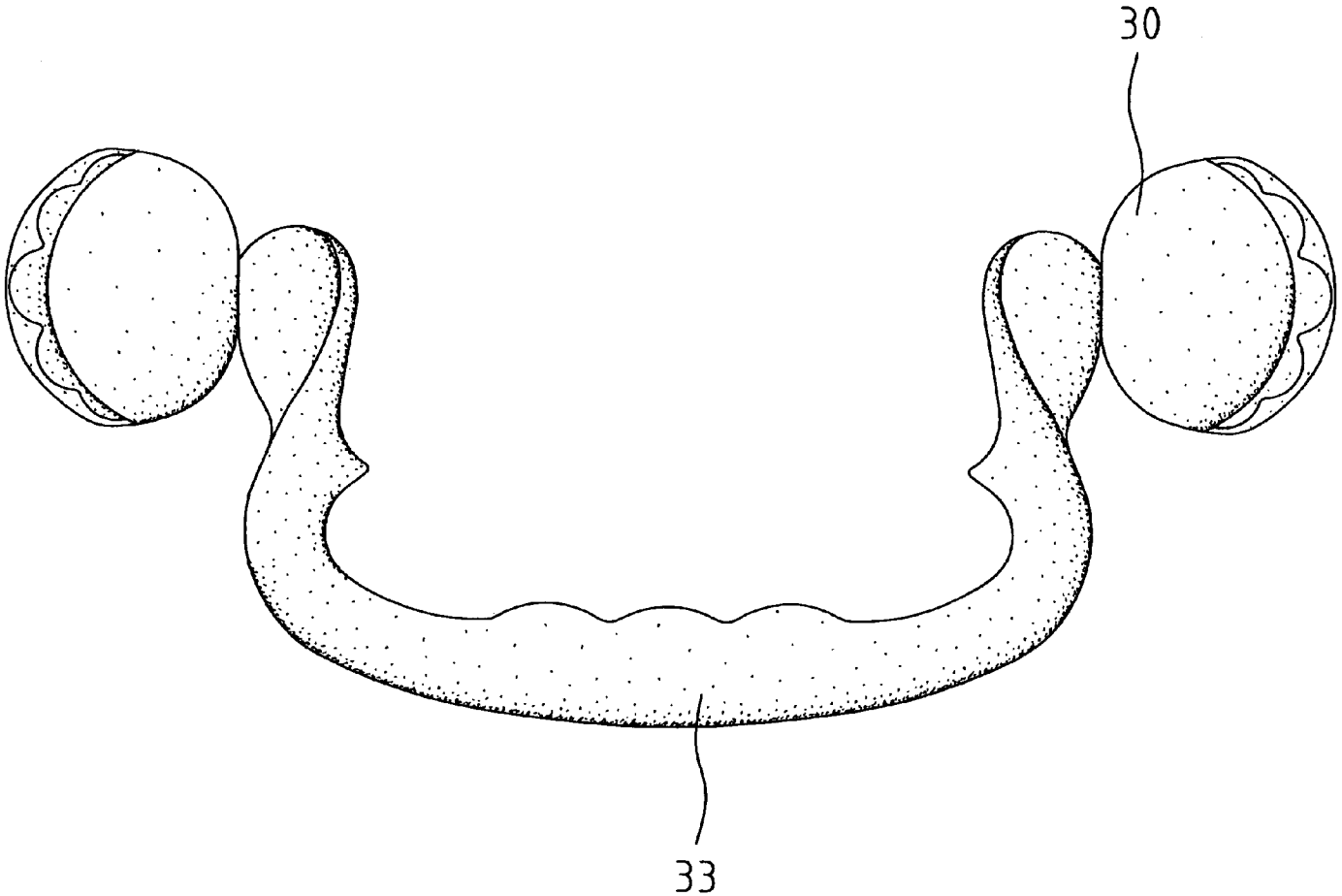
FIG. 8 is a front view of the handle assembly in FIG. 7.

FIGS. 7 and 8 illustrate a third embodiment of the handle assembly in accordance with the present invention. The handle assembly includes two positioning members 30 each having a rear surface 301 that is bonded to a furniture piece.

Each positioning member 30 includes a flat front surface 302 to provide a wider area for decorative purpose. Each positioning member 30 further includes a pin 31 and a stop 32 formed on an inner side 303 thereof. The handle assembly further includes a handle 33 that is substantially U-shape and includes two ends each having an outer face. Formed on the outer face of each end of the handle 33 are a pivotal hole 34 and a retaining notch 35. Each pin 31 is pivotally received in an associated pivotal hole 34. It is appreciated that each retaining notch 35 retains the associated stop 32 in a place such that a gap exists between the handle 33 and the positioning members 30 when the handle 33 is in a rest position, thereby allowing easy movement of the handle 33. Namely, the handle 33 can be easily grasped and turned to a position for operation.

Figure 8A:
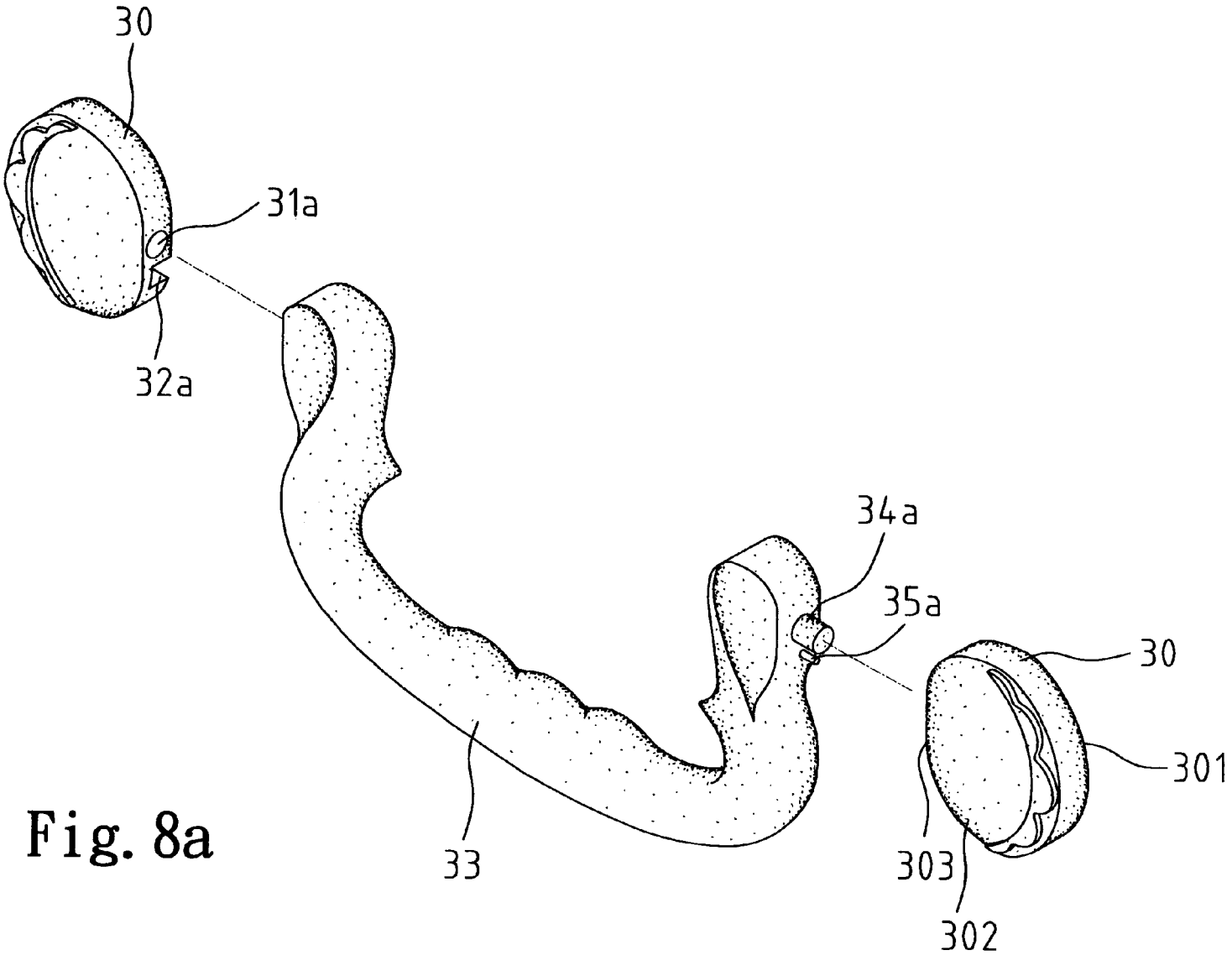
FIG. 8*a* is an exploded perspective view of an embodiment modified from the third embodiment.

FIG. 8*a* illustrates an embodiment modified from the third embodiment, wherein the inner side 303 of each positioning member 30 includes a pivotal hole 31*a* and a retaining notch 32*a,* and the outer face of each end of the handle 33 includes a pin 34*a* and a stop 35*a.*

Figure 9:
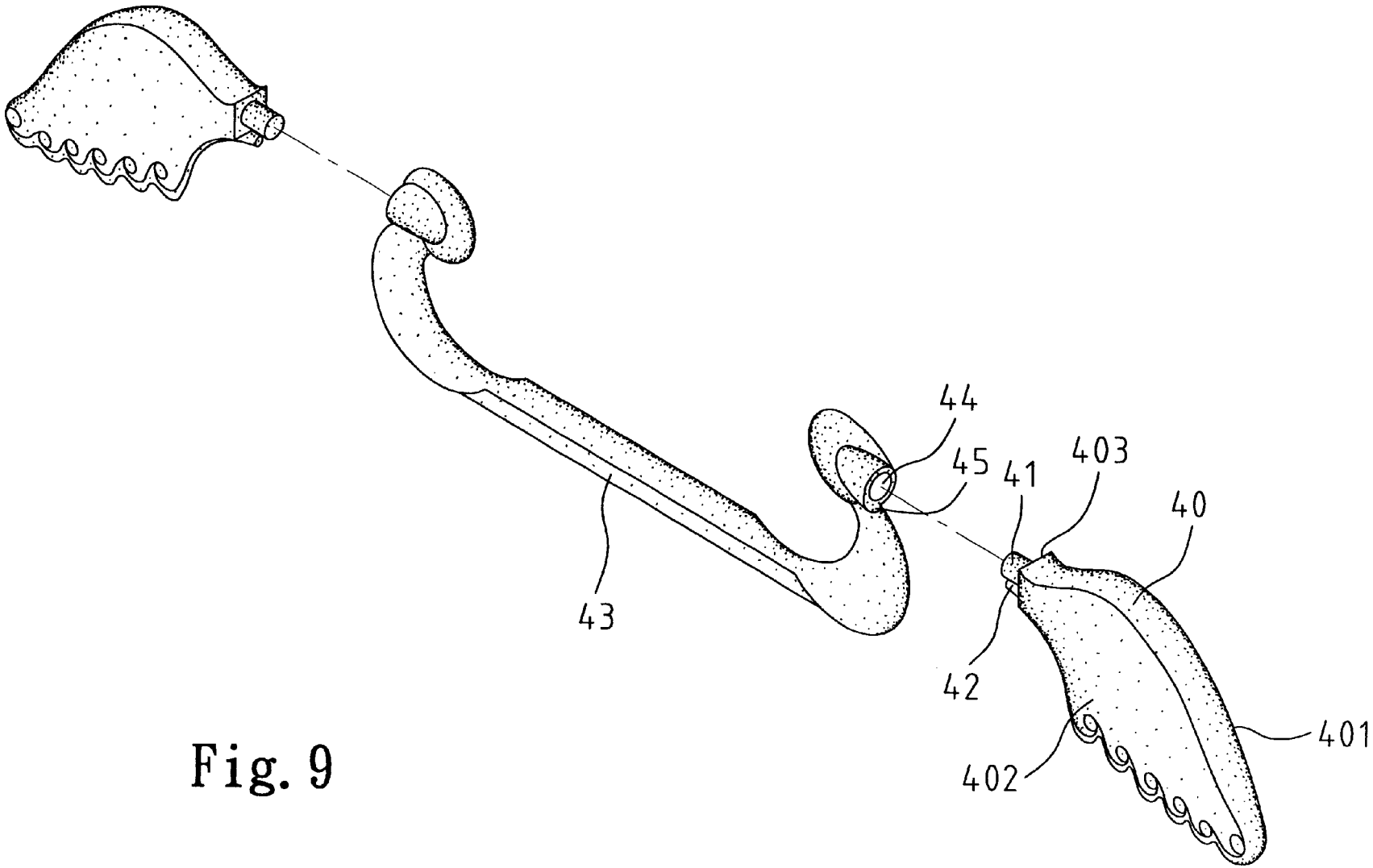
FIG. 9 is an exploded perspective view of a fourth embodiment of the handle assembly in accordance with the present invention.
Figure 10:
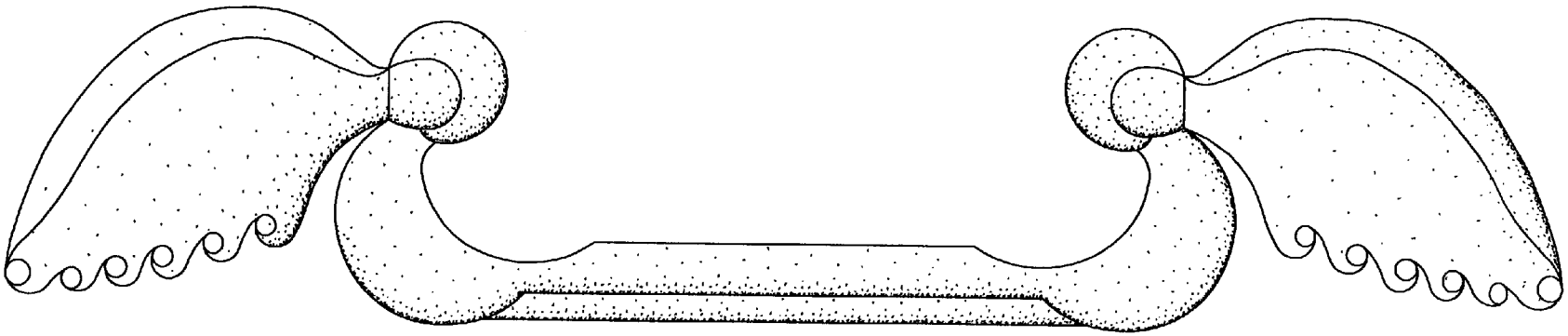
FIG. 10 is a front view of the handle assembly in FIG. 9.

FIGS. 9 and 10 illustrate a fourth embodiment of the handle assembly in accordance with the present invention. The handle assembly includes two positioning members 40 each having a rear surface 401 that is bonded to a furniture piece. Each positioning member 40 includes a flat front surface 402 to provide a wider area for decorative purpose. Each positioning member 40 further includes a pin 41 and a stop 42 formed on an inner side 403 thereof. The handle assembly further includes a handle 43 that is substantially U-shape and includes two ends each having an outer face. Formed on the outer face of each end of the handle 43 are a pivotal hole 44 and a retaining portion 45. Each pin 41 is pivotally received in an associated pivotal hole 44. It is appreciated that each retaining portion 45 retains the associated stop 42 in a place such that a gap exists between the handle 43 and the positioning members 40 when the handle 43 is in a rest position, thereby allowing easy movement of the handle 43. Namely, the handle 43 can be easily grasped and turned to a position for operation.

Figure 11:
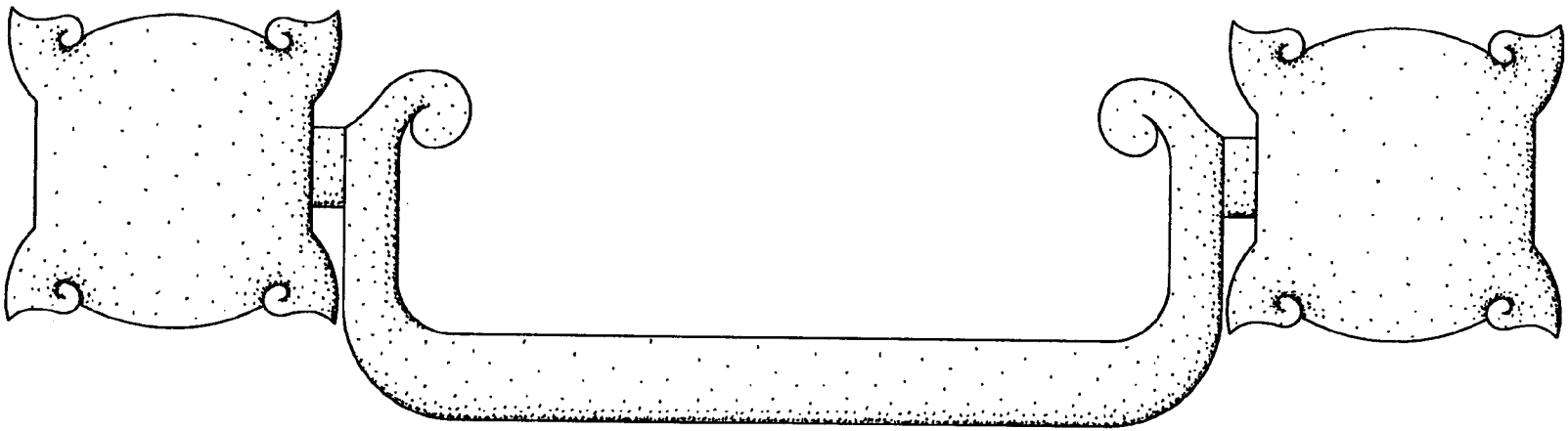
FIG. 11 is a front view illustrating a further modified embodiment of the handle assembly.

FIG. 11 illustrates a modified embodiment of the handle assembly, wherein the pattern on each positioning member is modified.

Figure 1:
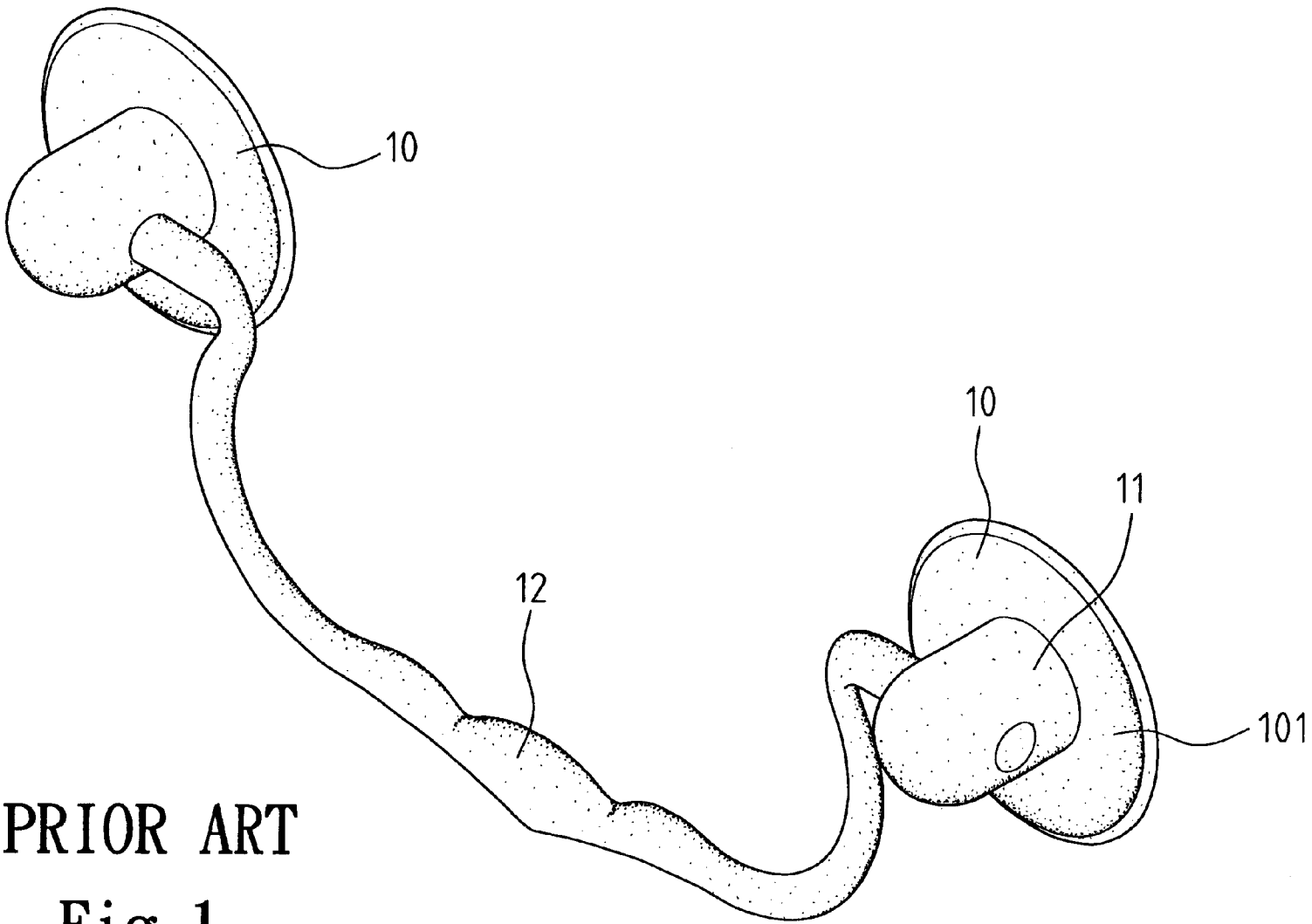
PRIOR ART Fig. 1
FIG. 1 is a perspective view of a conventional handle assembly.

It is noted that decoration is very important to furniture, as it may attract users and may provide an aesthetically pleasing effect. The handle assemblies in accordance with the present invention allow diverse decorative designs by means of providing a positioning member having a flat front surface. Thus, more decorative designs can be created, as the front surface has no functional projection (the stub 11 in FIG. 1) thereon.

Although the invention has been explained in relation to its preferred embodiment, it is to be understood that many other possible modifications and variations can be made without departing from the spirit and scope of the invention as hereinafter claimed.

What is claimed is:

1. A handle assembly comprising:

a positioning member including a rear surface adapted to be mounted to furniture and a front surface, with the positioning member defined between the rear and front surfaces being generally planar and having no functional projection beyond the front surface, the positioning member further including two lateral surfaces between the front and rear surfaces; and a handle including two ends pivotally connected to the lateral surfaces of the positioning member, respectively; and wherein each said lateral surface of the positioning member includes a pivotal hole and a retaining notch spaced from the pivotal hole, and wherein each said end of the handle includes a pin pivotally received in an associated said pivotal hole, each said end of the handle further including a stop separate from the pin and that is retained in place by an associated said retaining notch such that a gap exists between the handle and the positioning member when the handle is in a rest position.

2. The handle assembly as claimed in claim 1, with the front surface having a shape and size generally corresponding to the rear surface.

3. The handle assembly as claimed in claim 3, with the entire front surface being flat and having no functional projection thereon.

4. The handle assembly as claimed in claim 1, with the front surface having an outer periphery, with the two lateral surfaces extending from the outer periphery to the rear surface, with the entire front surface within the outer periphery being flat.

5. The handle assembly as claimed in claim 4, with the front surface having a shape and size generally corresponding to the rear surface.

6. A handle assembly comprising: a positioning member including a rear surface adapted to be mounted to furniture and a front surface, with the positioning member defined between the rear and front surfaces being generally planar and having no functional projection beyond the front surface, the positioning member further including two lateral surfaces between the front and rear surfaces; and a handle including two ends pivotally connected to the lateral surfaces of the positioning member, respectively; and wherein each said lateral surface of the positioning member includes a pin and wherein each said end of the handle includes a pivotal hole for pivotally receiving an associated said pin; wherein each said lateral surface of the positioning member further includes a stop separate from the pin and wherein each said end of the handle further includes a retaining notch separate from the pivotal hole and for retaining the handle in a place such that a gap exists between the handle and the positioning member when the handle is in a rest position.

7. A handle assembly comprising:

two positioning members each including a rear surface adapted to be mounted to furniture and a front surface, with each of the positioning members defined between the front and rear surfaces being planar and having no functional projection beyond the front surface, said positioning members further including mutually facing inner sides between the front and rear surfaces; and a handle including two ends pivotally connected to the inner sides of the positioning members, respectively; and wherein said inner side of each said positioning member includes a pivotal hole and wherein each said end of the handle includes a pin pivotally received in an associated said pivotal hole; and wherein said inner side of each said positioning member further includes a retaining notch separate from the pivotal hole and wherein each said end of the handle further includes a stop separate from the pin and that is retained in place by an associated said retaining notch such that a gap exists between the handle and the positioning members when the handle is in a rest position.

8. The handle assembly as claimed in claim 7, with the front surface of each of the positioning members having a shape and size generally corresponding to the rear surface.

9. The handle assembly as claimed in claim 8, with the entire front surface of each of the positioning members being flat and having no functional projection thereon, with each of the positioning members being formed as a single, integral component.

10. The handle assembly as claimed in claim 7, with the front surface of each of the positioning members having an outer periphery, with each of the positioning members including a lateral surface extending from the outer periphery of the front surface to the rear surface, with the inner sides being a portion of the lateral surface, with the entire front surface within the outer periphery being flat.

* * * * *